US006480168B1

(12) United States Patent
Lam et al.

(10) Patent No.: US 6,480,168 B1
(45) Date of Patent: Nov. 12, 2002

(54) COMPACT MULTI-BAND DIRECTION-FINDING ANTENNA SYSTEM

(75) Inventors: Tommy Lam, Endicott, NY (US); Paul R. Lavelle, Johnson City, NY (US); Kenneth W. Lee, Endicott, NY (US); Matthew J. Milicic, Jr., Newark Valley, NY (US); D. Michael Pritchett, deceased, late of Apalachin, NY (US), by Jean R. Pritchett, executor

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/664,801

(22) Filed: Sep. 19, 2000

(51) Int. Cl.[7] ..... H01Q 9/44
(52) U.S. Cl. ..... 343/805; 343/874
(58) Field of Search ..... 343/805, 745, 343/791, 806, 828, 878, 907, 874, 890

(56) References Cited

U.S. PATENT DOCUMENTS

| | | | | | |
|---|---|---|---|---|---|
| 3,579,244 | A | | 5/1971 | Dempsey | 343/797 |
| 3,673,516 | A | | 6/1972 | Spanos | 333/5 |
| 3,691,561 | A | | 9/1972 | Jager | 343/727 |
| 3,725,929 | A | | 4/1973 | Spanos | 343/844 |
| 3,824,596 | A | | 7/1974 | Guion et al. | 343/113 R |
| 3,939,477 | A | | 2/1976 | Green et al. | 343/113 R |
| 4,748,450 | A | * | 5/1988 | Hines et al. | 343/820 |
| 5,237,336 | A | | 8/1993 | Jelloul | 343/799 |
| 5,521,608 | A | * | 5/1996 | Brandt et al. | 343/749 |
| 5,835,067 | A | * | 11/1998 | Goodman | 343/828 |
| 5,995,063 | A | * | 11/1999 | Somoza et al. | 343/890 |
| 6,057,804 | A | * | 5/2000 | Kaegebein | 343/792 |

FOREIGN PATENT DOCUMENTS

| | | | |
|---|---|---|---|
| DE | 27 57 325 A1 | 12/1977 | |
| JP | 63-214003 | 9/1988 | H01Q/9/44 |

* cited by examiner

*Primary Examiner*—Don Wong
*Assistant Examiner*—Jimmy T. Vu
(74) *Attorney, Agent, or Firm*—Whitham, Curtis & Christofferson, P.C.

(57) ABSTRACT

An compact and rugged antenna system particularly suited to direction finding includes a plurality of antenna arrays for receiving respective frequency bands and colocated on a mast with separation between antenna arrays along the mast. The mast includes a coil wound of an insulator and functioning as a loaded inductor to shift the mast resonance out of the frequency band of the antenna system. A VHF dipole array having elements shaped to reduce scattering to UHF and SHF arrays is supported on movable arms which allow retraction that reduces height and provides mechanical protection to one or more other arrays as well as damping against vibration by contacting the mast with shaped portions of the dipole elements. The bowtie elements of the UHF array are angled at a central region to optimize array diameter at low UHF frequencies. A finned RF electronics housing is preferably provided which reduces solar loading and dissipates heat from antenna electronics. Asymmetrically keyed fittings are provided to permit accurate antenna system, array and element positioning and replaceable components and wiring, both internally and externally of the housing, is held in position to allow field repairs without recalibration.

27 Claims, 7 Drawing Sheets

COMPACT MULTI-BAND DIRECTION-FINDING ANTENNA SYSTEM

STATEMENT OF GOVERNMENT INTEREST

The invention was made with Government support under contract DAAB10-96-D-Q002, awarded by the U.S. Government. The U.S. Government has certain rights in this invention.

BACKGROUND OF THE INVENTION

1. Field of the Invention

The present invention generally relates to multi-band radio antennas and, more particularly, to direction finding antennas which are compact and suitable for use on vehicles under adverse conditions.

2. Description of the Prior Art

Wireless communications are currently used for many applications including data transmission, resource tracking, and emergency or safety services. Many of these applications involve determining the location or the direction of a transmitter of radio frequency signals which may be of any frequency over a broad spectrum. However, antenna efficiency and directional selectivity are dependent on the relationship of the frequency of the radio carrier signal and the dimensions of the antenna elements and the distances between them and, in general, efficiency of a given antenna system will be acceptable only over a relatively limited band of frequencies.

Therefore, multiple frequency band antenna subsystems are typically used to cover wide frequency range applications. However, the use of multiple antenna subsystems require significant physical separation between them to ensure adequate direction finding performance that may be degraded by interactions between such antenna subsystems. Performance can also be degraded by adverse mast resonance effects caused by common mode coupling of antenna subsystem elements to the mast. This mast resonance effect, if not controlled could cause dramatic phase change with relatively small frequency change that results in unreliable calibration and/or ambiguity of direction/azimuth in regard to the transmitted signal. It is well-recognized that this required separation of antenna subsystems imposes size restrictions for low frequency operation and vice-versa. Large size also often implies significant weight of the overall antenna system. Since many direction finding applications involve vehicles which must carry the antenna system, practical limitations on both size and weight may be imposed.

Further, land vehicles used in such applications are often operated in off-road environments where large antenna system size also implies an increased susceptibility to damage (e.g. from tree limbs and the like). Large, vehicle mounted antennas also generally require some arrangement for reducing shock and vibration due to terrain effects on the vehicle. Additionally, the antenna system and its components will exhibit degradation in performance due to temperature variation, particularly extreme temperature rise due to solar loading.

Even relatively compact antenna designs which are known may be of substantial size. For example, so-called bowtie antennas which are broad band radiators may be used in a cylindrical array but the bowtie element width must be large for adequate radiation efficiency at lower frequency ranges which adversely results in an electrically large diameter of the cylindrical array at a higher frequency range. This diameter of the cylindrical array limits the maximum frequency bandwidth operation of this antenna subsystem. In other words, this type of array design is not operated in an optimal frequency range and direction finding accuracy would be degraded.

In summary, particularly for direction finding applications, antenna system design must seek to answer numerous demands within a large and restrictive group of environmental constraints which are related in numerous complex ways and requiring numerous trade-offs between performance and physical configuration. Because of these trade-offs, no known design has been compact in size while having improved direction finding performance over a wide frequency band covering the VHF, SHF and UHF ranges, while being resistant to damage and providing good thermal and mechanical performance including reduced solar loading, improved heat dissipation from active elements and vibration damping and which can be readily and unambiguously calibrated.

In this regard, many details of known antenna systems are relatively critical to individual antennas of any given design. A change in routing of only a minor length of wire or a slight shift in relative location of elements and/or components of any given antenna system design may significantly alter antenna performance, particularly phase shift with frequency. Therefore, for direction finding applications, antenna systems must be individually calibrated. Some of these details, such as wire routing are particularly subject to change during repairs and it is generally the case with known antenna designs that the antenna must be recalibrated after any repair. Such recalibration requires specialized equipment and cannot generally be accomplished in the field.

SUMMARY OF THE INVENTION

It is therefore an object of the present invention to provide a direction finding antenna which is compact in size while having improved direction finding performance over a wide frequency band covering the VHF, SHF and UHF ranges (from below 25 MHz to above 2000 MHz), while being resistant to damage and providing good thermal and mechanical performance including reduced solar loading, improved heat dissipation from active elements and vibration damping.

It is another object of the invention to provide a compact, broad band direction finding antenna system suitable for use on a land vehicle and which exhibits common mode coupling to the mast which is shifted out of the antenna subsystem frequency band.

It is a further object of the present invention to provide a wide band antenna system which has improved characteristics for being transported, improved interoperability and which can be manufactured more economically and serviced in the field without recalibration.

In order to accomplish these and other objects of the invention, an antenna system is provided including a mast, a plurality of antenna arrays colocated on the mast but separated from each other antenna array by a distance along the mast, and a loaded inductor or the like for shifting a frequency of mast resonance out of the frequency bands of said plurality of antenna arrays.

Shaping of the VHF dipole array reduces scattering to other arrays while providing mechanical advantages including damping of vibration and protection for another array. The UHF array includes angled bowtie elements to improve frequency and phase response. other perfecting features of the preferred embodiment of the invention include fixtures for locating all removable electrical parts including wiring and components enclosed in a heat dissipating, finned RF electronics housing so that servicing and repair can be performed without recalibration and parts are made substantially interoperable. Asymmetrical keyed elements and connection arrangements assure alignment of antenna elements, antenna arrays and the entire antenna system.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1A:
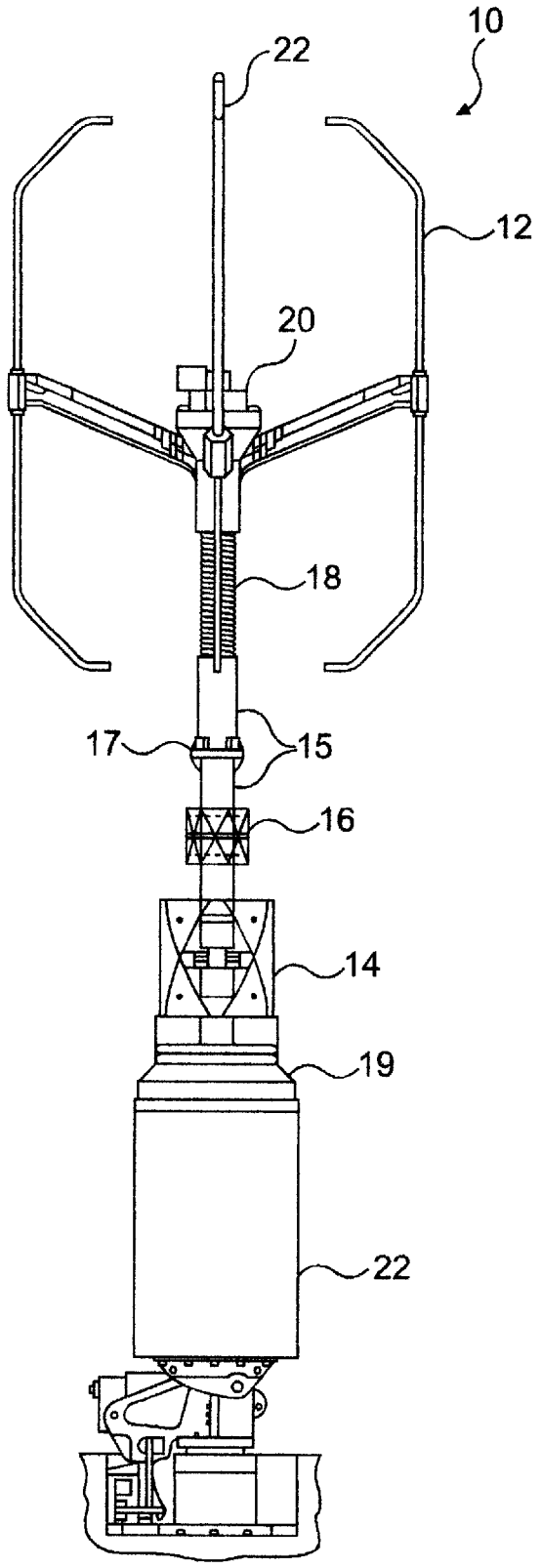
FIGS. 1A and 1B are side views of the antenna in accordance with the invention with the VHF array in deployed and retracted positions, respectively.
Figure 1B:
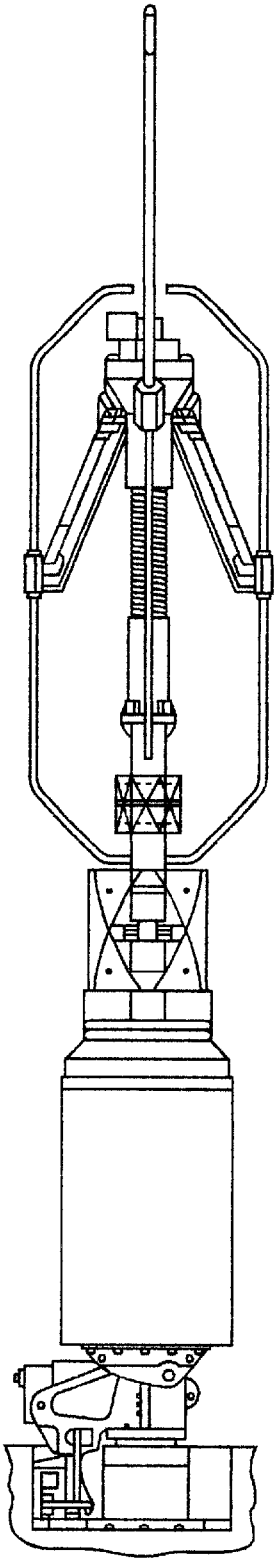

Referring now to the drawings, and more particularly to FIG. 1A, there is shown a side view of the antenna system 10 in accordance with the invention with the VHF section 12 in a deployed position. While this antenna system of the invention is quite compact, it is a feature of the invention that the largest (VHF) array 12 can be retracted for further reduction in the overall size of the antenna system in both height of the VHF dipoles and overall diameter, as shown in FIG. 1B to reduce likelihood of damage to the VHF dipole elements 12. It should be noted that when the VHF elements are retracted, a cage is formed around the SHF array 16 to reduce the likelihood of physical damage thereto. Further, the angle of the VHF dipole support to the horizontal, particularly in the retracted position provides substantial vibration and shock damping which can be augmented by additional damping in the actuator 20. A locking device which will be described below provides alignment of the asymmetrical dipole elements.

FIG. 1A is principally provided to provide a reference to particular subsystems and other significant structures of the antenna system 10 in accordance with the invention. The subsystems and structures are also shown in greater detail in other Figures and will be discussed in connection with those Figures. Basically, the invention includes a four-element VHF dipole array 12, a four-element angled bowtie element UHF array 14, an eight-element bowtie element SHF array 16, a mast 15 on which arrays 12, 14 and 16 are colocated (e.g. coaxially mounted) and a coil 18 wound on a dielectric mast section and an RF electronics housing 19. It is preferred that the mast include a fitting 17 by which the mast can be separated into two parts for shipping, reducing overall vehicle dimensions and the like. Two antenna sections 22 are also illustrated in FIG. 1A which are antennas for other purposes which may be conveniently be combined with the antenna system of the present invention but have no effect on the operation of the invention and need not be further discussed.

Figure 2A:
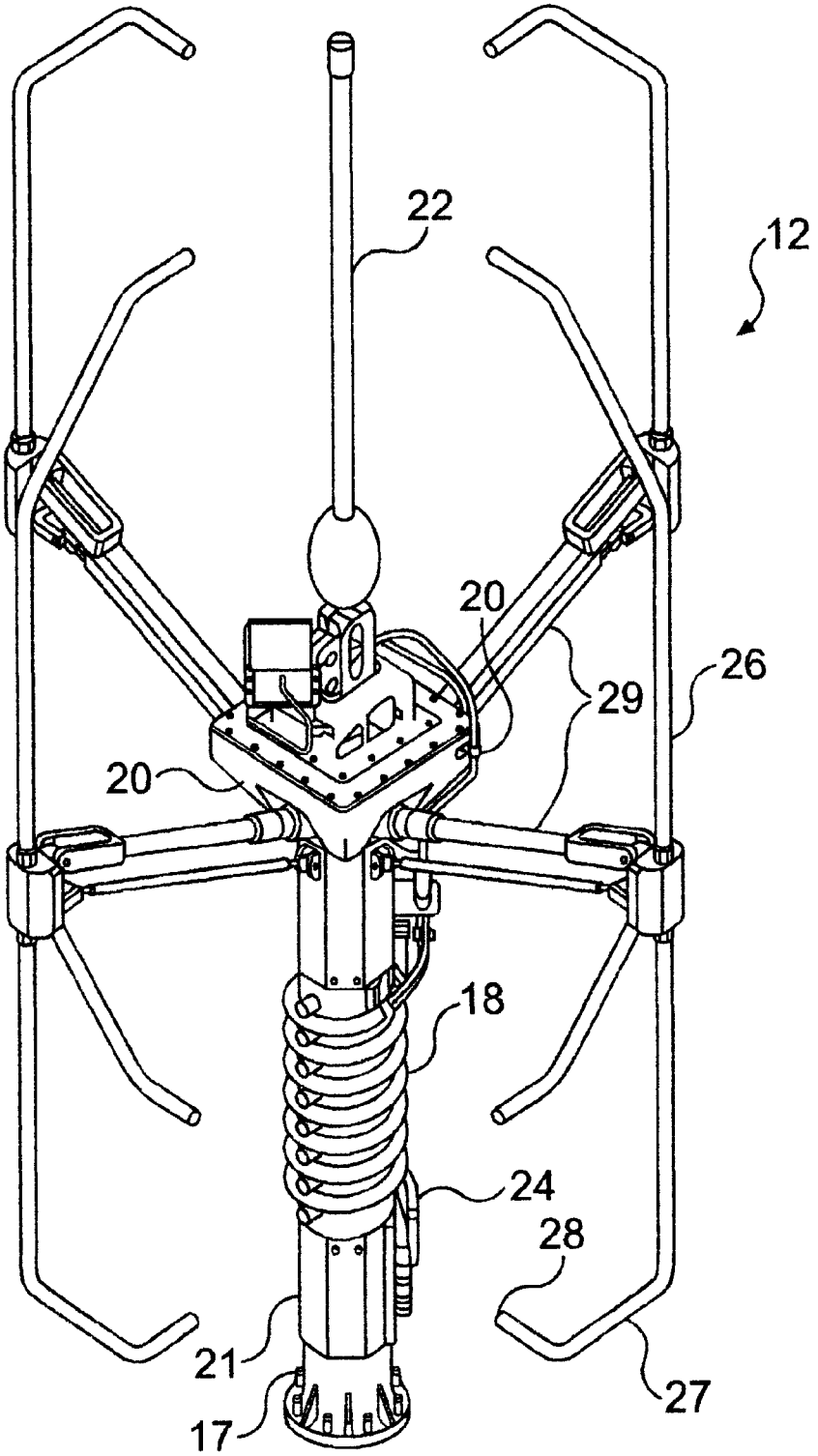
FIGS. 2A and 2B are perspective views of the upper VHF array and the lower SHF and UHF arrays, respectively.

Referring now to FIG. 2A, The features of the upper portion of the antenna system 10 (above fitting 17) in accordance with the invention will be discussed. The principal elements of this upper portion of the antenna system 10 are the coil 18 and the VHF dipole array.

The mast 21 is preferably formed of a light weight metal such as aluminum and includes a portion 24 formed of a dielectric material on which coil 18 is wound. (At the frequencies of interest, the dielectric material is not critical but fiberglass is preferred for its light weight and convenience of fabrication. Ferrite material would provide increased performance in regard to isolation effectiveness but is not preferred due to weight constraints.) This is considered to be a key feature of the invention since coil 18 serves as a loaded inductor between the VHF array 12 and the mast. This loaded inductor serves to shift the mast resonance frequency out of the frequency band of interest and provides electromagnetic isolation in the frequency range of interest minimizes direction finding errors due to common mode mast resonance. More specifically, FIG. 3 graphically shows the change of phase with frequency of an antenna system similar to that of the invention which does not include coil 18. The dramatically steep slopes of the change of phase with frequency are evident; in some regions changing by as much as 80° over a frequency range of a few hundred MHz as indicated by brackets 30, 32.

Figure 3:
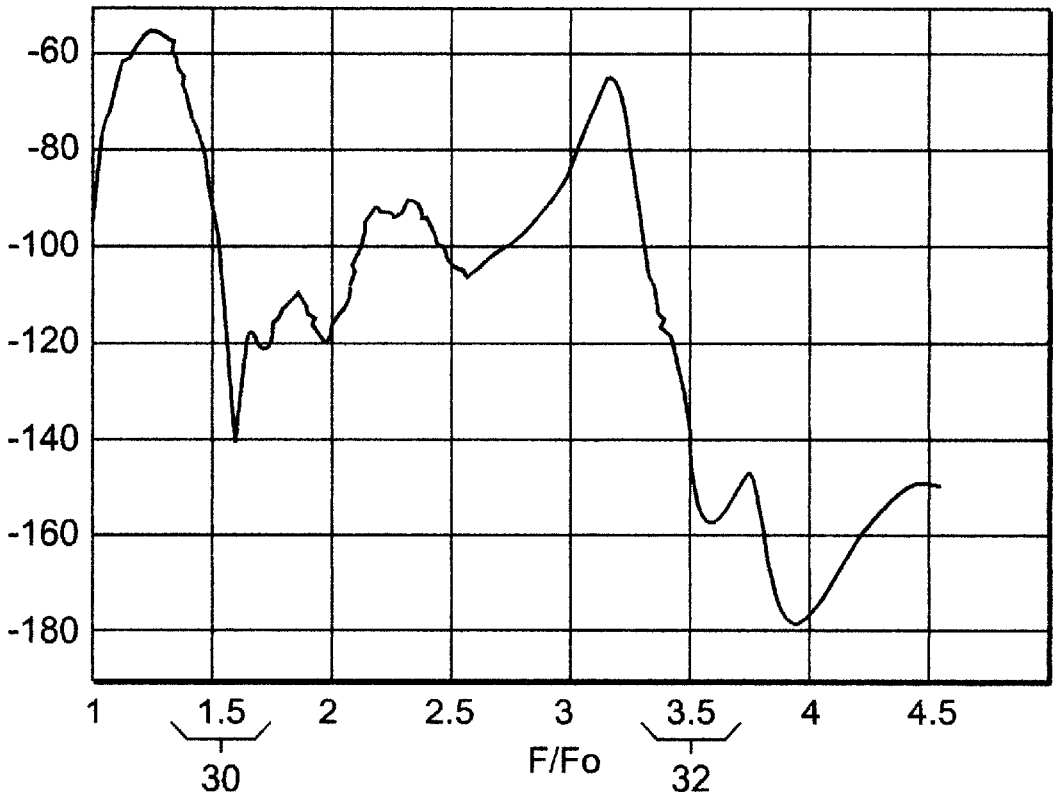
FIG. 3 is a graphical depiction of the phase change with frequency change in an exemplary antenna system of a prior design.
Figure 4:
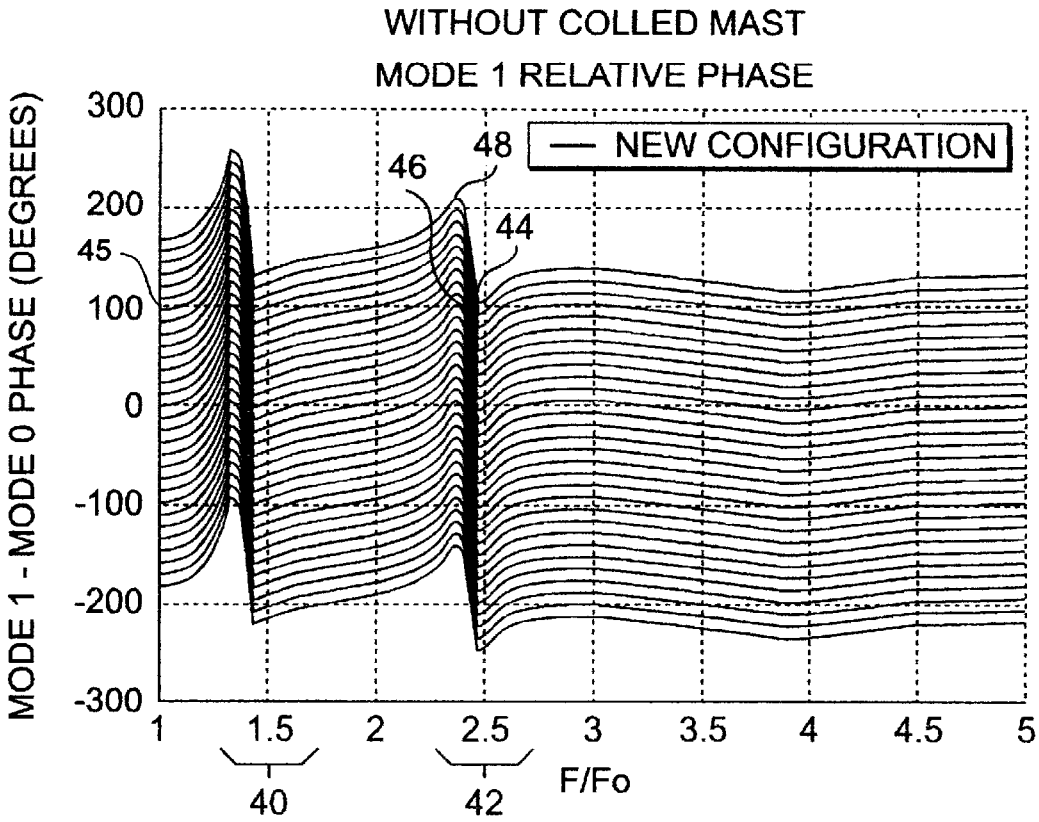
FIG. 4 is a graphical depiction of calibration values for azimuth with frequency for the phase change of FIG. 3.

For direction finding, changes in slope require calibration of azimuth as depicted in FIG. 4, corresponding to the phase change with frequency illustrated in FIG. 3 (and accessed by phase from, for example, a look-up table). In FIG. 4, each trace corresponds to a particular azimuth separated from the adjacent illustrated azimuth by a constant number of degrees in direction. The regions of steep slope 30, 32 result in sharp changes in calibration values in regions 40, 42 which result in calibration values for one direction being the same as values for a substantially differing direction at a very nearby frequency.

For example, each trace line in FIG. 4 represents phase response over frequencies at directional angular increments of 12°. As indicated at points 44 and 46, the phase response (FIG. 3) at the output of an antenna not using coil 18 is seriously convoluted over different azimuth directions. At Points 44 and 48, the traces cross each other as many as eight times which are equivalent to direction error or ambiguity of in excess of 100° in azimuth calibration values occurs over that frequency range; representing extremely low and ambiguous direction resolution (e.g. points 44, 45), particularly in certain frequency ranges.

Figure 5:
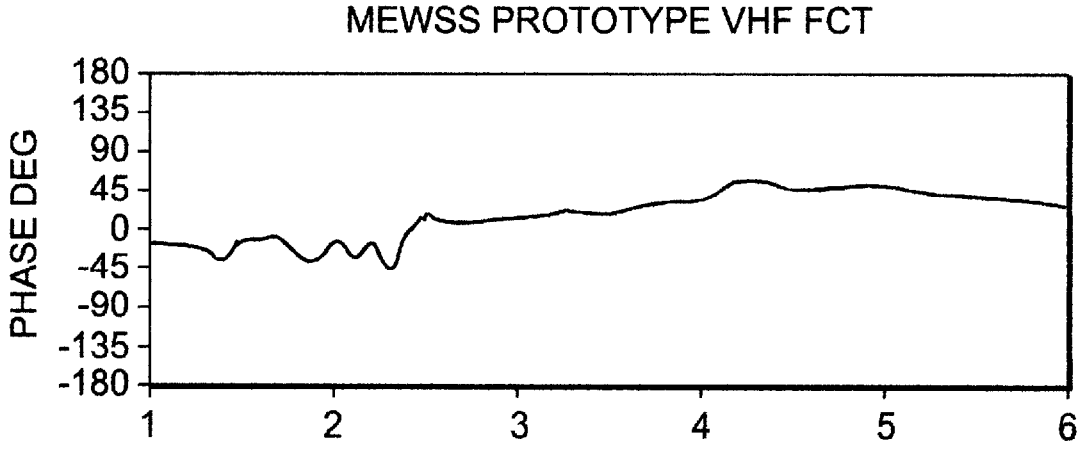
FIG. 5 is a graphical depiction of the phase change with frequency change in an exemplary antenna system in accordance with the invention.
Figure 6:
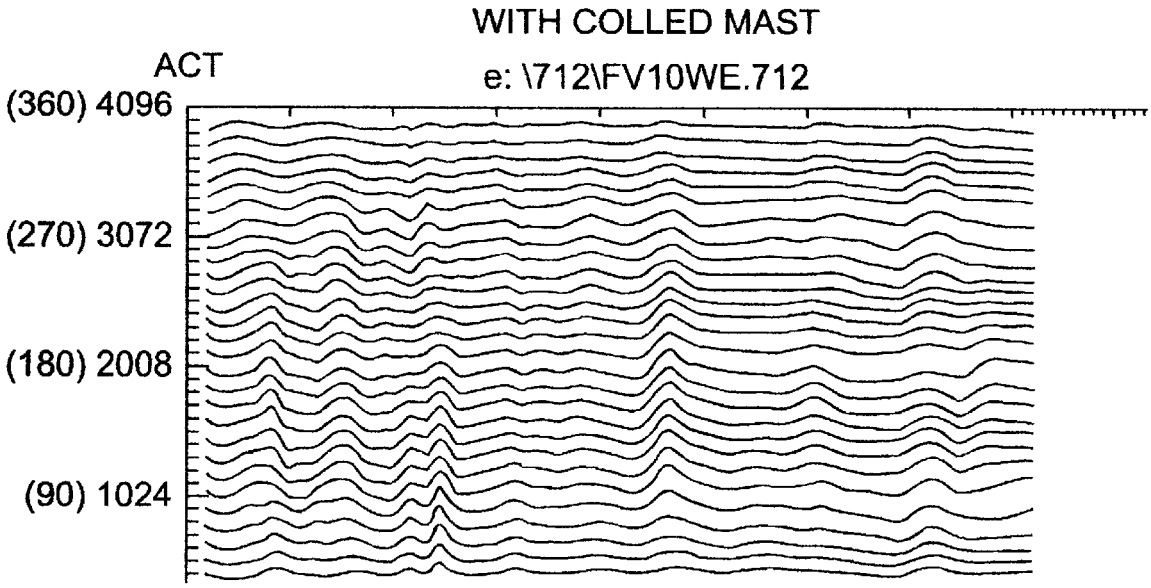
FIG. 6 is a graphical depiction of calibration values for azimuth with frequency for the antenna of the present invention.

In sharp contrast, the use of coil 18 to shift the mast resonance out of the frequency range of interest results in much reduced phase shift with change of frequency as illustrated in FIG. 5. As is readily apparent therefrom, phase changes only slowly with changes in frequency and is limited to only about 20° over the entire frequency band of the antenna. Corresponding calibration values for azimuth when coil 18 is employed are shown in FIG. 6. It is readily apparent that only small changes in calibration values are required and are substantially "flat" for any given azimuth. Therefore, the coil 18 provides a very substantial improvement in performance of the antenna system in accordance with the invention.

Returning to FIGS. 1A, 1B and 2A, another feature of the invention providing numerous meritorious effects is the particular shape of the VHF dipole elements 26 of VHF array 12. Specifically, dipole elements 26 include portions 27 and 28 which are angled inward. This shape is referred to as a "cross bow element" and serves to reduce scattering to the UHF and SHF arrays which are colocated downward on the mast and thus improves phase behaviors over azimuth direction and frequency. The lengths of portions 27 and 28 and the angles by which they are angled inward is not particularly critical to achievement of this effect. However, it is important that the shape of both ends of each dipole element are of substantially the same shape.

The "cross bow element", because of its asymmetric shape in azimuth forms a directional radiator pattern (on the order of 7 db front to back ratio) when illuminated by incident signals in the UHF and SHF frequency ranges. This outward pointing directional pattern increases the backscattering in the outward direction where no other antenna subsystem is located but, by the same token, reduces the backscattering in the direction of the location of the UHF and SHF array elements. As a result, UHF and SHF array performance are preserved.

It is also mechanically advantageous to arrange the shape of portions 27 and 28 so that the lower ends of the dipole elements rest against the mast when the dipole elements are in the retracted position as shown in FIG. 1B. The similar shape of the upper ends of the dipole elements 26 thus also form a cage-like enclosure which serves to provide mechanical protection for actuator 20 and the dipole element support arms 29 as well as coil 18 and the SHF array 16. In this regard, the contact of the bent portions of the dipole elements with the mast provides additional vibration damping and increased rigidity of the "cage" when the VHF array is in the retracted position. Also, because of the "cross bow" shape of the VHF elements a cradle can be used on the transport vehicle to support the mast at a location which would have been obstructed by a straight VHF dipole element when the antenna system is stowed in a horizontal position.

Figure 2B:
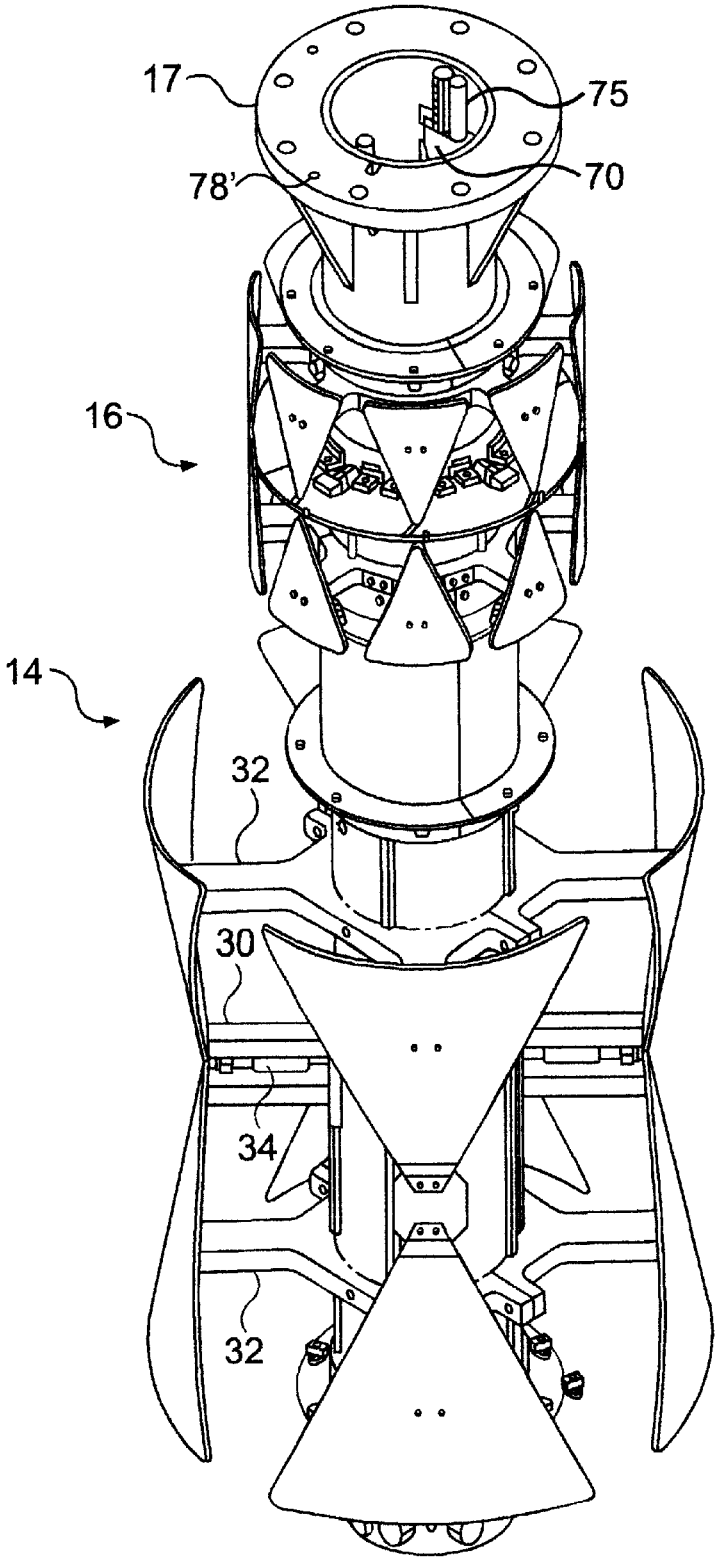

Referring now to FIGS. 1A and 2B, the UHF array 14 in accordance with the invention will now be discussed. As seen in FIG. 1A the UHF array is preferably comprised of four bowtie elements arranged in a generally cylindrical form and colocated on the mast near the base where its separation from the VHF array will be maximized. As discussed above, the coupling between the VHF array and the UHF array is substantially reduced by the use of coil 18 and the shaping of the VHF dipole elements 26, 27, 28. Therefore, it should be appreciated that the trade-off between coupling and proximity of the VHF and UHF arrays only requires such spacing as is conveniently available since coupling has already been reduced to a very low level.

Accordingly, the height of mast and the height of the deployed VHF array may be kept low (and further reduced in the retracted position) to avoid potential damage, increase strength and rigidity through height reduction and permit minimization of weight. By the same token, the movement of the VHF dipole elements from the retracted position to the deployed position allows sufficient separation of the VHF array from the UHF and SHF arrays without sacrificing mast weight, rigidity or length.

The individual bowtie elements are also modified in several ways from the conventional form. First, the bowtie elements are curved to be arcuate when viewed parallel to the axis of the mast to reduce size and avoid protruding corners of the bowtie elements which would otherwise be more susceptible to damage. Further, each bowtie element is angled outwardly toward the top and bottom from the center where electrical connection is made. Since the energy of lower frequencies is principally nearer the outer ends of the bowtie element the outward angling of the bowtie elements provides a more nearly ideal array diameter and more consistent gain over the UHF band. Further, a shorter connection is provided to the center of each bowtie element which tends to avoid grating lobes at the upper ends of the UHF band so that no large phase ripples are induced in the azimuth pattern.

The SHF array preferably includes eight bow tie elements such that the element-to-element spacing is restricted to avoid grating lobes and is colocated on the mast between the VHF array 12 and the UHF array 14. Less spacing is required at higher frequencies to avoid deleterious effects of coupling and, in any event, coupling has already been reduced by the effects of coil 18 and the shaping of the VHF dipole elements 26 in the same manner as with the UHF array 14, discussed above. The individual bowtie elements are curved for the same reasons as the bowtie elements of the UHF array 14 but outward angling of the elements is not generally necessary either to optimize diameter or to reduce dimensions. Protection from damage is provided by the VHF array elements when in the retracted position.

In summary of the foregoing, a key feature of the present invention is the coil 18 which shifts resonances out of the frequency band of interest and reduces coupling between the VHF, UHF and SHF arrays while improving phase response and greatly simplifying calibration and avoiding calibration ambiguity.

Consequently, the separation between arrays can be reduced and overall dimensions of the antenna system further reduced and mechanical qualities improved by the nesting of the arrays relative to the retracted VHF dipole position. Weight and strength/rigidity are not compromised by the provision of adequate separation when the VHF dipoles are moved to the deployed position by virtue of the mounting of the dipoles on movable arms. Additional damping is provided by the actuator. Curvature of the bowtie elements of the UHF and SHF arrays reduces overall dimensions and reduces susceptibility to damage while the outward angling of the bowtie elements of the UHF array 14 provides optimization of diameter over the UHF frequency band and improves matching of the response with the VHF and SHF arrays at the extremes of the UHF band. Therefore, each of the above described features of the invention enhances not only the electrical and mechanical performance of the antenna but further enhance the electrical and mechanical performance effects of the other features.

Figure 7:
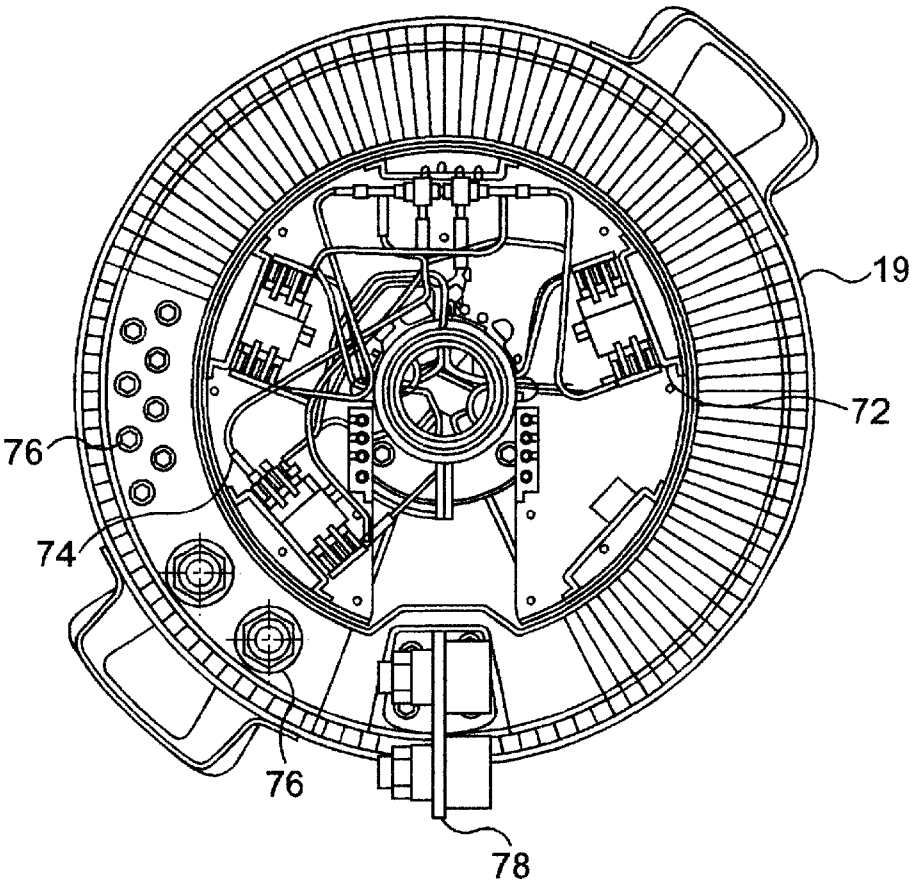
FIG. 7 is a bottom view of the upper section of the RF electronics housing in accordance with the invention.

Referring now to FIGS. 7 and 2B a further perfecting feature of the invention will now be discussed. It was noted above that antenna response and performance can be significantly affected by routing of wiring and location of RF electronics components. Further, when the antenna is used for direction finding purposes, it is critical that the alignment of the antenna system be known. For both of these reasons, it has been necessary to recalibrate the antenna system when any part of the antenna system is disassembled and reassembled. Therefore, field repairs and routine disassembly for transportation and other purposes have not been feasible since equipment for recalibration may not be available upon reassembly and/or the cost and time of frequent recalibration of the antenna system may be prohibitive.

Accordingly, the antenna system of the present invention preferably includes self-aligning fixtures such as that shown at 70 of FIG. 2B to fix the location of all external wiring. These fixtures also prevent the loss of calibration from routinely encountered vibration, shock and the like while allowing the external wiring to be removed and replaced as necessary without loss or alteration of calibration.

Similarly, as shown in FIG. 7, similar fixtures 72, 74 are provided for both wiring and all other removable electronic components in the RF electronics housing 19 (FIG. 1A). Therefore, all components and wiring can be serviced in the field without recalibration of the antenna system (assuming, of course, that the individual electronic components are manufactured to a suitably high uniformity). At the same time, fixtures 72 provide for the strategic location of heat-generating components to have good heat transfer to housing 19, which is preferably provided with heat-dissipating fins in the nature of a heat sink. Additional heat gain from solar loading is also minimized thereby. Further, fixtures 76 are preferably provided in an asymmetric fashion to establish the location of self-aligning connections to electrical connections 75 (FIG. 2B) in the mast.

These connections also serve to repeatably align the antenna system to a vehicle or other support. A further asymmetrically located fixture 78, 78' can be optionally or alternatively provided for the same purpose at the antenna system base and at fitting 17 (FIG. 1A). Therefore the antenna system can be removed from a support and disassembled routinely and at will without loss of alignment or calibration.

Figure 8:
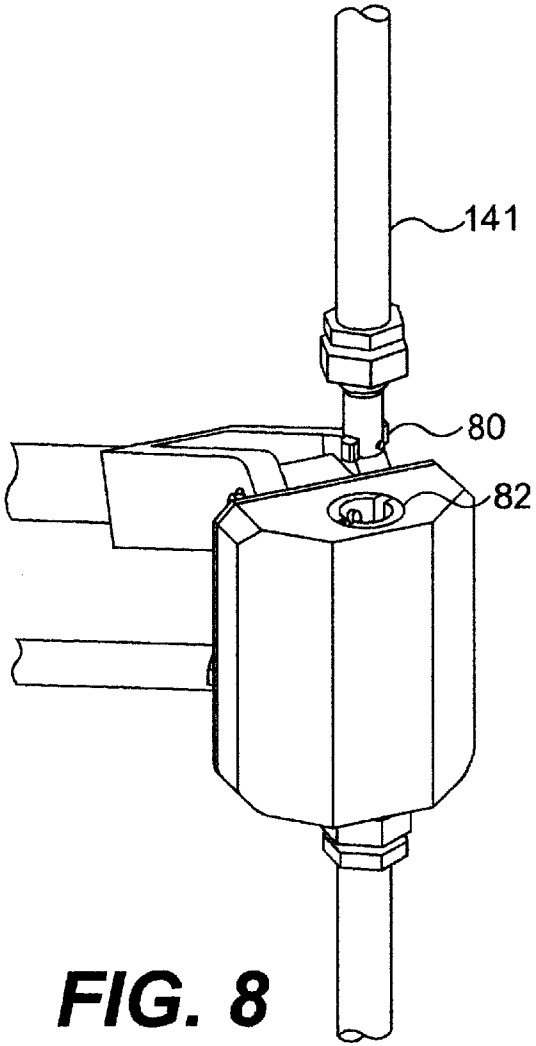
FIG. 8 is a partially exploded perspective view of a VHF element support showing a keyed locking member in accordance with the invention.

As a further perfecting feature of the invention, it is also preferred to form the VHF dipole elements in separate parts for each element, as shown in detail in FIG. 8. Specifically, since the dipole elements are subject to damage and performance will be degraded (and calibration affected) by dimensional distortion, forming the dipole elements as separate, preferably identical halves allows simple and rapidly executed replacement while requiring fewer spare replacement elements 14' of reduced size. Further, since these elements are asymmetrical, it is preferred to provide a keyed locking mechanism to assure that proper location and orientation of the dipole elements is achieved.

In view of the foregoing, it is seen that the invention achieves greatly enhanced mechanical and electrical performance at a reduced size over previously known antenna system arrangements. Substantially uniform broad band performance is achieved while avoiding severe changes in phase response with frequency, simplifying calibration. The mechanical arrangement is of reduced size and weight while being of increased strength and rigidity and provides a significant degree of protection of some elements with other elements while increasing resistance to potential damage of those elements and the antenna system as a whole.

While the invention has been described in terms of a single preferred embodiment, those skilled in the art will recognize that the invention can be practiced with modification within the spirit and scope of the appended claims.

What is claimed is:

1. An antenna system including a mast, a plurality of antenna arrays colocated on said mast, each said antenna array being separated from each other antenna array by a distance along said mast, and means for shifting a frequency of mast resonance out of the frequency bands of said plurality of antenna arrays.

2. The antenna system as recited in claim 1, wherein said means for shifting said frequency of mast resonance is a loaded inductor.

3. The antenna system as recited in claim 1, wherein said means for shifting said frequency of mast resonance is a coil wound on an insulator forming a portion of said mast.

4. The antenna system as recited in claim 3, wherein said coil and said insulator are located between two arrays of said plurality of arrays on said mast.

5. The antenna system as recited in claim 1, wherein said plurality of antenna arrays include a VHF array and an UHF array.

6. The antenna system as recited in claim 5, wherein said means for shifting said frequency of mast resonance is a coil wound on an insulator forming a portion of said mast.

7. The antenna system as recited in claim 6, wherein said coil and said insulator are located between said VHF array and said UHF array.

8. The antenna system as recited in claim 5, wherein said VHF array includes a plurality of dipole elements, said dipole elements being shaped to reduce scattering to other arrays of said plurality of arrays.

9. The antenna system as recited in claim 8, further including means for moving said dipole elements between a deployed position and a retracted position, said retracted position being relatively closer to said mast and a base of said mast than said deployed position.

10. The antenna system as recited in claim 9, wherein said dipole elements contact said mast in said retracted position.

11. The antenna system as recited in claim 9, wherein shaped portions of said dipole elements surround another array of said plurality of arrays in said retracted position.

12. The antenna system as recited in claim 8, wherein said dipole elements are formed in two parts which are detachable from a support with a keyed fitting.

13. The antenna system as recited in claim 1, wherein said plurality of antenna arrays include a four-element VHF dipole array, a four-element UHF angled bowtie array and an eight-element SHF bowtie array.

14. The antenna system as recited in claim 5, wherein said UHF array includes a plurality of bowtie elements arranged around said mast.

15. The antenna system as recited in claim 14, wherein each of said bowtie elements is angled at a central portion thereof in a direction such that distance from said mast increases toward respective ends of each said bowtie element.

16. The antenna system as recited in claim 1, further including means for holding wires in a fixed location relative to said mast.

17. The antenna system as recited in claim 1, further including an RF electronics housing at a base of said mast.

18. The antenna system as recited in claim 17, wherein said RF electronics housing includes heat dissipating fins.

19. The antenna system as recited in claim 17, wherein said RF electronics housing includes means for holding removable components in respective fixed locations within said RF electronics housing.

20. The antenna system as recited in claim 19, wherein said RF electronics housing includes heat dissipating fins and said means for holding removable components includes means for locating heat generating components in respective positions for transfer of heat to said heat dissipating fins.

21. The antenna system as recited in claim 20, further including means for holding wires in a fixed location relative to said mast.

22. The antenna system as recited in claim 21, further including a fitting for assembling and disassembling said mast.

23. The antenna system as recited in claim 22, wherein said fitting includes parts asymmetrically keyed to each other.

24. The antenna system as recited in claim 22, further including means for removably attaching said mast to said RF electronics housing.

25. The antenna as recited in claim 24, wherein said means for removably attaching said mast to said RF electronics housing further includes parts asymmetrically keyed to each other.

26. The antenna system as recited in claim 1, further including means for removably attaching said mast to a support.

27. The antenna as recited in claim 24, wherein said means for removably attaching said mast to said support further includes parts asymmetrically keyed to each other.

* * * * *